US005908327A

United States Patent [19]

Tsuji et al.

[11] Patent Number: 5,908,327

[45] Date of Patent: Jun. 1, 1999

[54] ELECTRICAL CONNECTOR WITH COVER ASSEMBLY

[75] Inventors: Takeshi Tsuji; Masaaki Tabata, both of Yokkaichi, Japan

[73] Assignee: Sumitomo Wiring Systems, Ltd., Japan

[21] Appl. No.: 08/890,817

[22] Filed: Jul. 11, 1997

[30] Foreign Application Priority Data

Jul. 12, 1996 [JP] Japan ..... 8-183551

[51] Int. Cl.[6] ..... H01R 13/58

[52] U.S. Cl. ..... 439/470

[58] Field of Search ..... 439/470, 465, 439/466, 731

[56] References Cited

U.S. PATENT DOCUMENTS

| | | | |
|---|---|---|---|
| 4,108,527 | 8/1978 | Douty et al. . | |
| 4,421,376 | 12/1983 | Cosmos et al. . | |
| 5,391,092 | 2/1995 | Sumida | 439/470 |
| 5,422,437 | 6/1995 | Schnell . | |
| 5,762,520 | 6/1998 | Martin | 339/103 M |

FOREIGN PATENT DOCUMENTS

| | | |
|---|---|---|
| 0 080 813 | 6/1983 | European Pat. Off. . |
| 0080813 | 6/1983 | European Pat. Off. . |
| 2-227973 | 9/1990 | Japan . |

*Primary Examiner*—Gary Paumen
*Assistant Examiner*—Antoine Ngandjui
*Attorney, Agent, or Firm*—Anthony J. Casella; Gerald E. Hespos; Ludomir A. Budzyn

[57] ABSTRACT

A cover 20 includes a pair of half pieces 20A which could be obtained by dividing a rectangular tube into halves by a plane extending parallel to two opposed wall of such a rectangular tube. The pair of half pieces 20A have the same configuration and are assembled in rotationally inverted positions about an axis. When assembling the cover 20, it is not necessary to precisely select different types of parts to be assembled as in the case where a cover has two types of parts having different configurations. This leads to a better operability, reduced production costs, and easy storage and handling.

5 Claims, 4 Drawing Sheets

ELECTRICAL CONNECTOR WITH COVER ASSEMBLY

BACKGROUND OF THE INVENTION

1. Field of the Invention

The present invention relates to a connector which protects wires coming out of a connector housing by a cover.

2. Description of the Prior Art

A known connector which employs a cover to protect wires coming out of a connector housing is shown in FIG. 7. In this connector, wires (not shown) come out of a connector housing 1 through its rear end surface, and a tubular cover 2 is mountable on a rear end portion of the connector housing 1 so as to surround the wires. The cover 2 is formed by assembling two half pieces 2A, 2B. These two half pieces 2A, 2B have similar shapes, but have different lock members for holding the half pieces 2A, 2B together.

Specifically, the half piece 2A has two contact edges for abutting comparable edges on the other half piece 2B. Two projections 3 project outwardly from each contact edge. The other half piece 2B has two elastic lock portions 4 projecting from each of its contact edges. The elastic lock portions 4 are dimensioned and configured to snap over and engage the projections 3. When the two half pieces 2A, 2B are assembled, the projections 3 and the lock portions 4 are engaged with each other, thereby holding the half pieces 2A, 2B together.

Since the cover 2 is formed by assembling two types of half pieces 2A, 2B having different configurations, different half pieces 2A, 2B to be assembled must be selected precisely. This leads to a poor operability when the cover 2 is mounted.

The present invention was developed in view of the above problem, and an object thereof is to improve operability when a cover is mounted.

SUMMARY OF THE INVENTION

According to the invention, there is provided a connector, comprising a connector housing with an end surface. Wires extend out of the end surface of the connector housing. A tubular cover is mounted on an end portion of the connector housing, and substantially surrounds the wires. The cover is formed by assembling a pair of half pieces having the substantially same configuration. However the half pieces are oriented in portions that are rotationally inverted about an axis.

Since the half pieces of the cover have the same configuration, it is not necessary to precisely select different types of parts to be assembled when assembling the cover. Thus, the inventive connector has a better operability as compared to the prior art where the cover is constructed by assembling parts with different configurations.

According to a preferred embodiment, an engaging portion is formed at a selected location on each half piece and preferably on one of two contact edges thereof. A receiving portion is formed at a different location on each half piece and preferably on the other contact edge. The locations of the engaging and receiving portions are selected to enable the engaging portion of one half piece to mate with the receiving portion of another half piece when the half pieces are rotated and then aligned. Thus separation of the half pieces is restricted by the engagement of the engaging portions of both half pieces with the receiving portions of the mating half pieces. Accordingly, since the engaging portion and the receiving portion for holding the half pieces together are formed in the half pieces themselves, the cover can be held in its assembled condition without using a separate part.

Preferably, the receiving portion is formed on the outer surface of the half piece and the engaging portion is so formed on the outer surface of the mating half piece as to permit elastic deformation of the engaging portion in a direction that enables the engaging portion to be disengaged from the receiving portion. Accordingly, the cover can be disassembled, i.e. the half pieces can be separated, by elastically deforming the engaging portion exposed on the outer surface of the half piece to disengage it from the receiving portion. Since the engaging portions are provided on the outer surfaces of the half pieces, the cover can be easily disassembled and/or detached.

Preferably, at least two engaging portions and at least two mating receiving portions are formed on the half pieces such that when the two half pieces are connected or fitted to each other, one engaging portion on one half piece is arranged in a direction substantially opposed to a direction of an adjacent engaging portion on the other half piece. Accordingly there is avoided or prevented an unwanted release of the two half pieces.

At least one positioning portion preferably is provided for positioning the pair of half pieces in a predetermined relative position. Positioning portions may be provided on each half piece, and preferably on a contact edge thereof. Since both half pieces can be positioned in their assembled state, the assembling can be performed easily and a displacement or misalignment of the half pieces along the contact surfaces can be prevented. At least two positioning portions may be provided at positions substantially spaced apart in the longitudinal direction. Thus one positioning portion may be provided on the outer side of the half pieces and another positioning portion may be provided on the inner side of the half pieces.

According to a further preferred embodiment, the tubular cover is to be mounted on the rear end portion of the connector housing in such a manner as to substantially surround the wires.

Preferably, the cover comprises connector housing engaging means for the engagement with cover engaging means of the connector housing to mount the cover to the connector housing. Further preferably, the cover comprises tube engaging means for the engagement with cover engaging means of a protection tube for the wires. The cover may comprise an opening for the insertion of the protection tube into the cover.

These and other objects, features and advantages of the present invention will become more apparent upon a reading of the following detailed description and accompanying drawings.

DETAILED DESCRIPTION OF THE PREFERRED EMBODIMENT

A first embodiment of a connector according to the invention is illustrated in FIGS. 1–5 and comprises a connector housing 10 which accommodates terminals (not shown) inside. A cover 20 is mounted on a rear end portion of the connector housing 10, and preferably a corrugated tube 30 (as a protection tube) is mounted on or at the cover 20.

Figure 1:
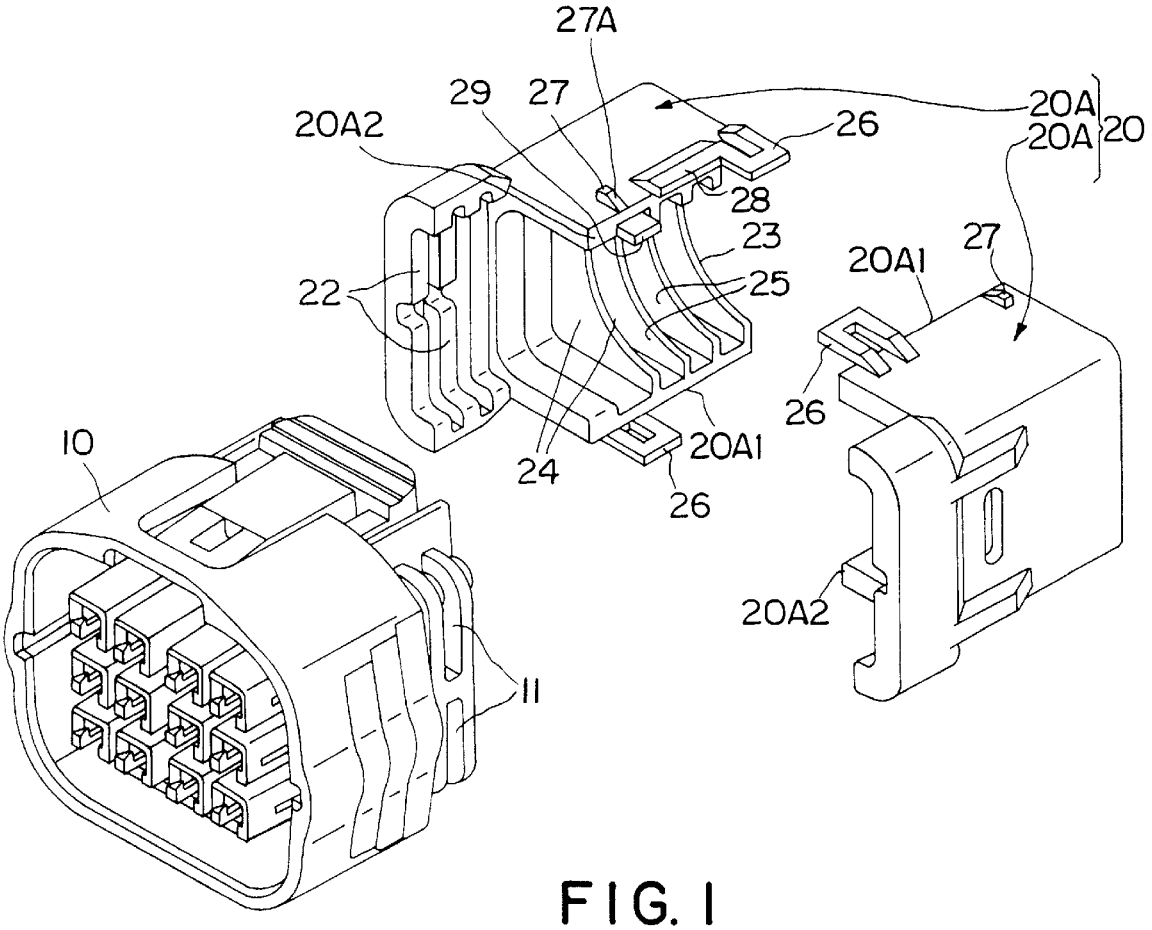
FIG. 1 is an exploded perspective view of a first embodiment of the invention.

A plurality of wires (not shown) are connected with the terminals and come out of the connector housing 10 through a rear end surface, which is the end of the connector housing 10 opposite that shown in FIG. 1. Vertically extending mount grooves 11 are formed in the opposite side surfaces of the rear end portion of the connector housing 10 for mounting the cover 20. The mount grooves 11 are transversely and/or substantially vertically symmetrical.

Figure 2:
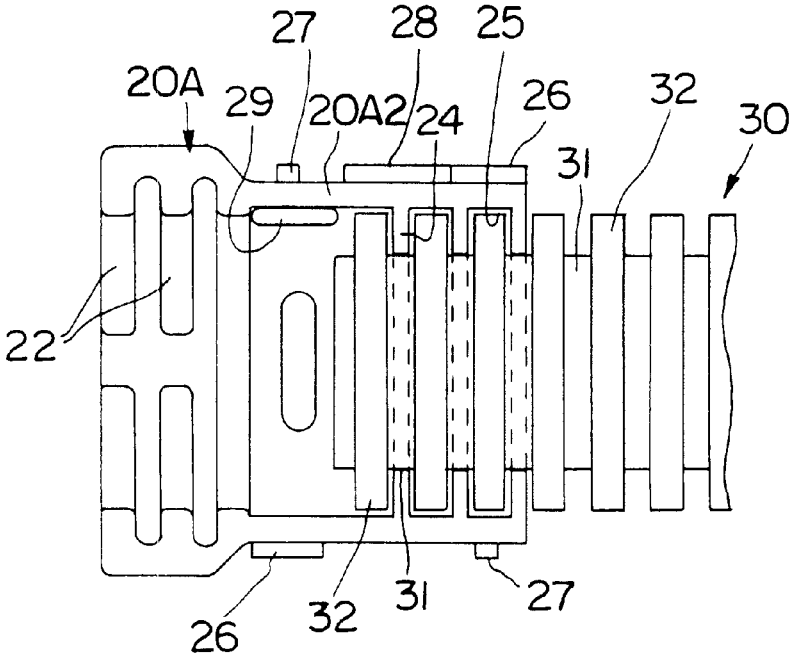
FIG. 2 is a side view in section showing a state where a corrugated tube is engaged with half pieces of the first embodiment.
Figure 3:
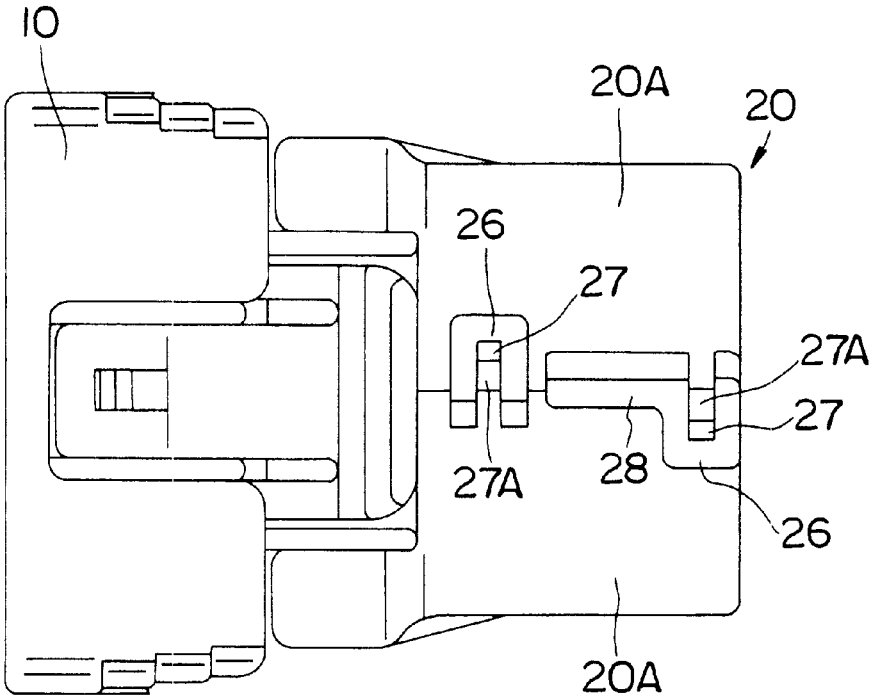
FIG. 3 is a plan view of the first embodiment when a cover is mounted on a connector housing.

Wires coming out of the connector housing 10 preferably are surrounded by the corrugated tube 30 having circumferentially extending grooves 31 and projections 32 alternately formed in its outer surface as shown in FIG. 2. The corrugate tube 30 is spaced from the connector housing 10, but is movable or extendable along its length and relative to both the wires and the connector housing 10. By being surrounded by the corrugated tube 30, the wires are protected without being exposed. Lock plates or projections 24 and lock grooves or recesses 25 of the cover 20, to be described later, are to be engaged with the grooves 31 and the projections 32 of the corrugated tube 30 for lockingly connecting the cover 20 with the corrugated tube 30.

The cover 20 includes a front end portion 20F for mounting to the rear end portion of the connector housing 10. The cover 20 also includes a rear end portion 20R for receiving the corrugated tube 30.

The cover 20 comprises a pair of half pieces 20A which could be obtained by dividing a rectangular tube into halves by a plane extending parallel to two opposed sides of the rectangular tube. Each half piece 20A has a first contact edge 20A1 and a second contact edge 20A2. The first and second contact edges 20A1 and 20A2 are symmetrical about a line or axis passing centrally therebetween. The pair of half pieces 20A preferably have substantially the same configuration and preferably are assembled in rotationally inverted positions about the central axis of the cover 20 such that a first contact edge 20A1 of one half piece 20A abuts a second contact edge 20A2 of a second half piece 20A. When the pair of half pieces 20A are assembled to form the cover 20 and are mounted on the connector housing 10, the tubular cover 20 substantially surrounds the portions of the wires coming out of the connector housing 10 to protect the wires.

Figure 4:
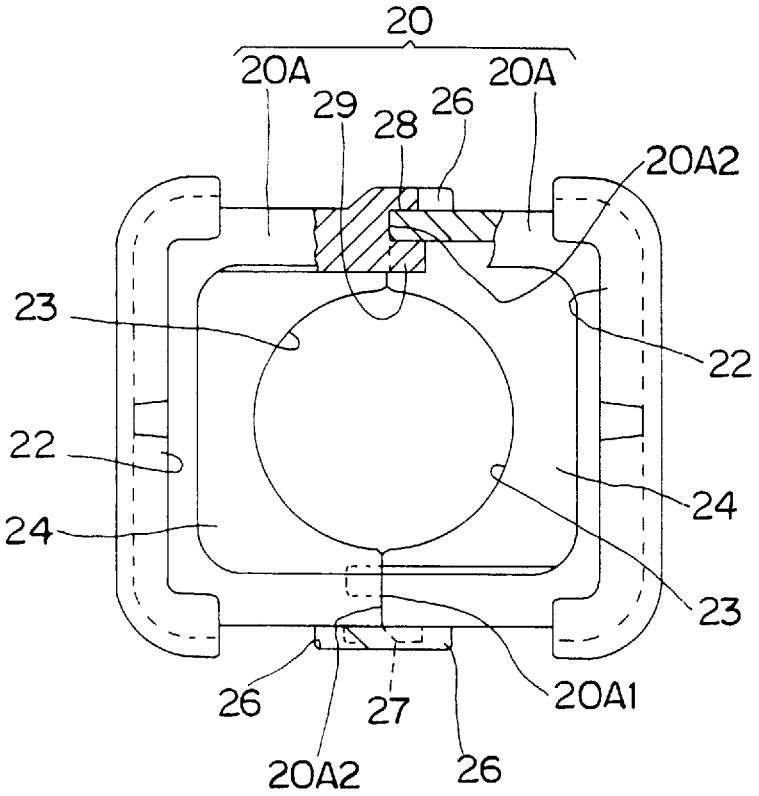
FIG. 4 is a rear view partly in section of the first embodiment when the cover is assembled.
Figure 5:
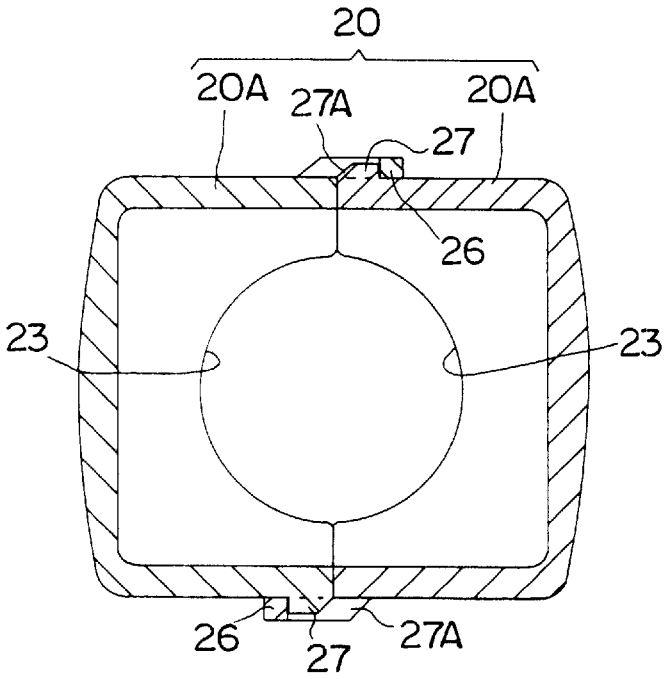
FIG. 5 is a section of the first embodiment when the cover is assembled.

In the inner surface of a front end portion of each half piece 20A are formed mount portions 22 as shown in FIGS. 1, 2 and 4. The mount portions 22 are engageable with the corresponding mount grooves 11 of the connector housing 10. By engaging the mount portions 22 with the mount grooves 11, a relative movement of the half pieces 20A, i.e. of the cover 20, with respect to the connector housing 10 along forward and backward directions and/or along vertical directions is restricted.

In the rear end surface of each half piece 20A is formed a preferably substantially semicircular notch 23 for of receiving the corrugated tube 30 therein. The shape of the notch or opening 23 is adapted or corresponds to the shape of the corrugated tube 30, and in particular to the shape of the leading end of the corrugated tube 30 to be connected to the cover 20. On the inner surface of each half piece 20A are formed the lock plates 24 and the lock grooves 25 which are to be engaged with the grooves 31 and the projections 32 on the outer surface of the corrugated tube 30. When they are engaged, the lock plates 24 and the projections 32 are substantially locked with each other, thereby restricting a loose movement of the corrugated tube 30 with respect to the cover 20 along longitudinal direction of the corrugated tube 30.

An engaging portion 26 and a receiving portion 27 are formed on each contact edge 20A1 and 20A2 of the half pieces 20A which abut or interact or are engaged with each other when the half pieces 20A are assembled. The contact edge 20A1 has the engaging portion 26 near its front end and the receiving portion 27 near its rear end. Conversely, the contact edge 20A2 has the engaging portion near its rear end and the receiving portion near its front end. With this construction, a half piece 20A in a pair of identical half pieces may be rotated about the central axis such that the contact edge 20A1 of one half piece 20A will be opposed to the contact edge 20A2 of the other half piece 20A. In this orientation, the engaging portions 26 on either of the half pieces 20A will align with the receiving portions 27 on the opposed half piece 20A.

Each receiving portion 27 projects from the outer surface of the half piece 20A, and is formed with a slanted surface 27A for allowing a smooth engagement of the receiving portion 27 with the engaging portion 26.

Each engaging portion 26 projects sideways from the contact edge 20A1 and 20A2 along the outer surface of the half piece 20A, and an opening for engagement with the receiving portion 27 is formed in its projecting portion. The engaging portions 26 engage the corresponding receiving portions 27 while being located on the outer surface of the mating half pieces 20A in an assembled state, and are elastically deformable in a direction away from the outer surface of the mating half pieces 20A (in a direction to be disengaged from the receiving portions 27).

An outer surface positioning portion 28 is formed between the engaging portion 26 and the receiving portion 27 on the second contact edge 20A2. This positioning portion 28 extends along the length of the contact edge and projects sideways from the second contact edge 20A2 along the outer surface of the half piece 20A. An inner surface positioning portion 29 projects substantially sideways from the second contact edge 20A2 at a position on the inner surface corresponding to the position of the receiving portion 27. These positioning portions 28, 29 hold the first contact edge 20A1 of the mating half piece 20A from opposite sides along inward and outward directions in the assembled state. It should be noted that the positioning portions 28, 29 are preferably not formed on the first contact edge 20A1.

When the cover 20 is mounted on the connector housing 10, the pair of half pieces 20A are fitted to the rear end portion of the connector housing 10 sideways after being located in rotationally inverted positions about the central axis. During this operation, the mount portions 22 of a first half piece 20A initially are partly engaged with the mount grooves 11 of the connector housing 10, and the lock plates 24 and the lock grooves 25 of a second and substantially the same or identical half piece 20A are partly engaged with the grooves 31 and the projections 32 of the corrugated tube 30.

The second half piece 20A then is fitted to the connector housing 10, and the first half piece 20A is fitted to the corrugated tube 30. Thus the mount portions 22 of the first and second fitted half pieces 20A are engaged with the mount grooves 11 of the connector housing 10. Simultaneously, the lock plates 24 and the lock grooves 25 of the first and second half pieces 20A are engaged with the grooves 31 and the projections 32 of the corrugated tube 30. This mating causes the engaging portions 26 and the opposed receiving portions 27 of both half pieces 20A to be engaged with each other. The first contact edges 20A1 of the mating half pieces 20A are held between the outer and inner surface positioning portions 28 and 29 of the respective second contact edges 20A2. In this way, the half pieces 20A are assembled as the tubular cover 20, and this cover 20 is mounted on the rear end portion of the connector housing 10 at the same time the corrugated tube 30 is engaged with the cover 20.

In the mounted state, a loose displacement of the cover 20 with respect to the connector housing 10 is restricted by the engagement of the mount portions 22 and the mount grooves 11, and the separation of the half pieces 20A along transverse direction and a displacement thereof along forward and backward directions are restricted by the engagement of the engaging portions 26 with the receiving portions 27. The displacement of the half pieces 20A along substantially vertical direction is restricted by the outer and inner surface positioning portions 28, 29 holding the first contact edges 20A1 therebetween.

As described above, according to this embodiment, the cover 20 is formed by assembling a pair of half pieces 20A having the same configuration in rotationally inverted positions about an axis. Accordingly, when assembling the cover 20, it is not necessary to precisely select different types of parts to be assembled as in the case where a cover is comprised of two types of parts having different configurations. This leads to a better operability, reduced production costs, and easy storage and handling.

Further, according to this embodiment, since the engaging portions 26 and the receiving portions 27 for holding the half pieces 20A assembled are formed in the half pieces 20A themselves, the cover 20 can be held assembled without using a part separate from the half pieces 20A.

When the cover 20 is disassembled and/or detached, the engaging portions 26 exposed on the outer surface of the half pieces 20A can be easily disengaged from the receiving portions 27 only by being elastically deformed outwardly. In this respect as well, this embodiment has a good operability.

Figure 6:
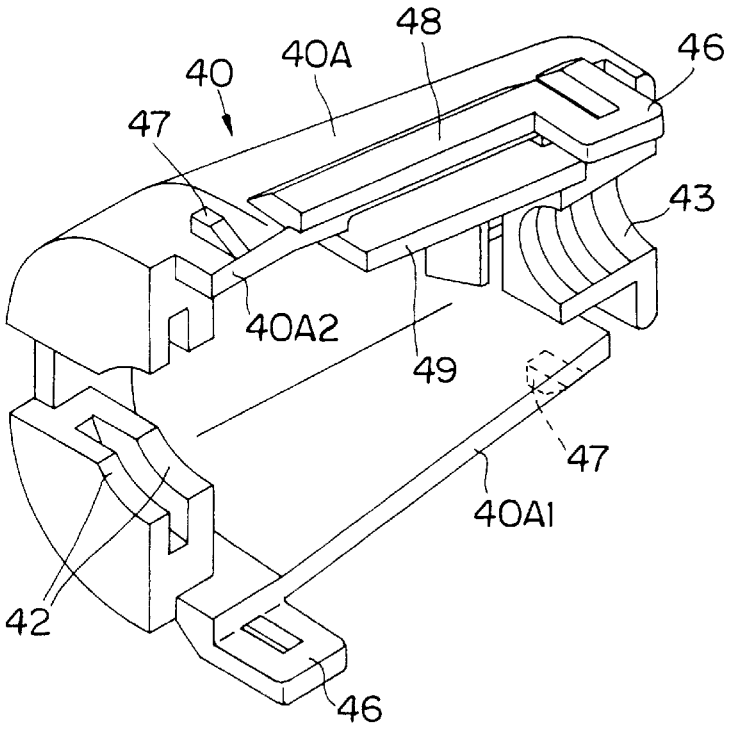
FIG. 6 is a perspective view of a half piece according to a second embodiment.
Figure 7:
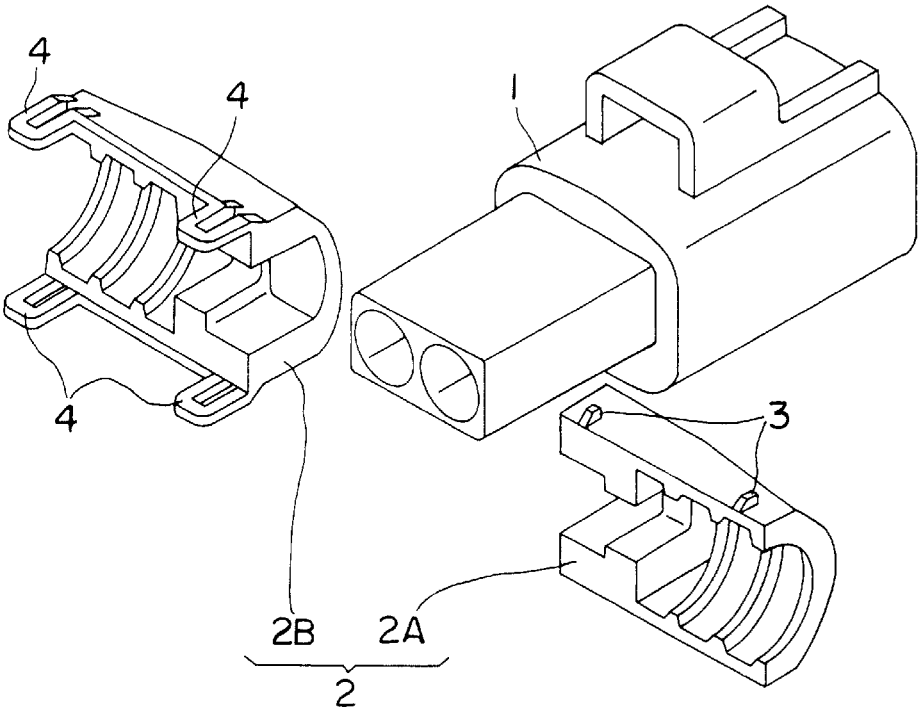
FIG. 7 PRIOR ART
FIG. 7 is a perspective view of a prior art connector.

A second embodiment is illustrated in FIG. 6 and differs from the first embodiment in the construction of the cover. Since the basic constructions of the connector housing and of the corrugated tube except their dimensions and configurations are similar or same to those of the first embodiment, the constructions thereof are neither illustrated nor described here.

A cover 40 according to the second embodiment is comprised of a pair of half pieces 40A which could be obtained by dividing a preferably rectangular tube into halves as described with respect to the first embodiment. The pair of half pieces 40A preferably have the same configuration and are assembled in rotationally inverted positions about an axis.

In the inner surface of a front end portion of each half piece 40A are formed mount portions 42 which are engageable with mount grooves of a connector housing (not shown). In the rear end surface of each half piece 40A is formed a substantially semicylindrical insertion portion 43 used for the insertion of wires (not shown). First and second contact edges 40A1 and 40A2 are defined on the half pieces 40A and come into contact with each other when the half pieces 40A are assembled. Engaging portions 46 and receiving portions 47 are formed on the contact edges 40A1 and 40A2. Since the configuration and arrangement of the engaging portions 46 and the receiving portions 47 are similar to their counterparts of the first embodiment, no description is given thereon.

In the half piece 40A located on the right side with respect to the rear end surface of the connector housing when viewed from behind or from the wire side (state as shown in FIG. 6), an outer surface positioning portion 48 is formed between the engaging portion 46 and the receiving portion 47 on the second contact edge 40A2. This positioning portion 48 substantially extends along the length of the second contact edge 40A2 and projects substantially sideways from the contact edge along the outer surface of the half piece 40A. On the second contact edge 40A2 where the outer surface positioning portion 48 is formed, there also is formed an inner surface positioning portion 49 which extends substantially over the entire length of the outer surface positioning portion 48. Specifically, the positioning portion 49 extends along substantially forward and substantially backward directions along the second contact edge 40A2 and projects substantially sideways along the inner surface of the half piece 40A. These positioning portions 48, 49 hold the upper contact edge of the mating half piece 40A from opposite sides in inward and outward directions in the assembled state.

Since the long outer and inner surface positioning portions 48, 49 extend along forward and backward directions in the second embodiment, a parallel displacement of the half pieces 40A along vertical direction along the contact surfaces as well as a rotational displacement thereof along the contact surfaces can be securely restricted.

The present invention is not limited to the described and illustrated embodiments. For example, the invention is also applicable to a connector provided with no corrugated tube. Although the receiving portions and the engaging portions are engageable projections and holes in the foregoing embodiments, according to the invention, the receiving portions may be recesses or holes formed in the outer surface of the half pieces and the engaging portions may be fitted in these recesses or holes. Instead of the engaging portions and the receiving portions formed in the half pieces, the pair of half pieces may be held assembled by a separate part. Although the engaging portions and the receiving portions are formed on the outer surfaces of the half pieces in the foregoing embodiments, they may be formed on the inner surfaces of the half pieces or the contact surfaces of the contact edges thereof, so that the engaged portions of the engaging portions and the receiving portions are not exposed to the outside of the cover in the assembled state. Although the positioning portions project from the contact edge along the outer and inner surfaces thereof in the foregoing embodiments, a projection and a recess which are engageable with each other may be formed in the contact surfaces of both half pieces as positioning portions according to the invention. The corrugated or projection tube 30 may be used for preventing (or protecting from) excessive bending or damage of the wires W at the opening 23, and may be formed with circumferentially spaced openings (not shown) allowing for its radial bending (outside of the cover 20; 40). The protection tube 30 may be arranged on only a portion of the wires W and not only over their substantially entire length outside the connector 10 and the cover 20; 40.

These and other variations of the subject connector are considered to be within the scope of the invention as defined by the appended claims.

What is claimed is:

1. A cover assembly for secure mounting to a connector housing and for protecting wires extending from the connector housing, said cover assembly being substantially tubular and comprising a pair of identical half pieces securely engaged with one another, each said half piece being semi-tubular and having an inner surface, an outer surface and first and second longitudinal contact edges, the first contact edge of each said half piece engaging the second contact edge of the other of said half pieces in said pair, at least the second contact edge of each said half piece having positioning means for ensuring a selected positioning of the edges of the respective half pieces in the pair of said half pieces, the positioning means comprising an inner positioning wall extending from portions of said inner surface of each said half piece adjacent said second contact edge, said inner positioning wall being disposed in supporting engagement with the inner surface of the other of said half pieces adjacent the first contact edge thereof, each said edge further having at least one edge engagement means for engagement with one of said edge engagement means on the other of said half pieces in said pair of said half pieces.

2. A cover assembly according to claim 1, wherein said positioning means further comprises an outer positioning wall extending continuously from the outer surface of each said half piece adjacent the second contact edge thereof, said outer positioning wall being configured to lie in supporting engagement with the outer surface of the other of said half pieces adjacent the first contact edge thereof.

3. The cover assembly according to claim 1, wherein the edge engagement means comprises a resiliently deflectable engaging portion adjacent each said first contact edge and a receiving portion adjacent each said second contact edge, the engaging portion of each said half piece being securely engaged with the receiving portion of the other of said half pieces.

4. A cover assembly according to claim 3, wherein each said half piece includes an inner surface and an outer surface, the engaging portion and the receiving portion being disposed respectively on the outer surfaces of said half pieces, such that the engaging portions of the respective half pieces are accessible for selectively disengaging said half pieces.

5. The cover assembly of claim 4, wherein each said half piece further includes a second resiliently deflectable engaging portion adjacent the second contact edge thereof and a second receiving portion adjacent the first contact edge thereof, the second engaging portion of each said half piece releasably engaging the second receiving portion of the other of said half pieces of said cover assembly.

* * * * *